US011033094B2

(12) United States Patent
Berdych

(10) Patent No.: US 11,033,094 B2
(45) Date of Patent: Jun. 15, 2021

(54) DEVICE FOR CARRYING SETS OF DOCUMENTS AND CONTAINERS OF VARIOUS SIZES

(71) Applicant: David E. Berdych, Silver Spring, MD (US)

(72) Inventor: David E. Berdych, Silver Spring, MD (US)

( * ) Notice: Subject to any disclaimer, the term of this patent is extended or adjusted under 35 U.S.C. 154(b) by 0 days.

(21) Appl. No.: 16/834,281

(22) Filed: Mar. 30, 2020

(65) Prior Publication Data

US 2020/0305586 A1 Oct. 1, 2020

Related U.S. Application Data

(60) Provisional application No. 62/825,907, filed on Mar. 29, 2019.

(51) Int. Cl.

| | |
|---|---|
| ***A45F 5/00*** | (2006.01) |
| ***A45F 5/10*** | (2006.01) |
| *A45F 5/12* | (2006.01) |

(52) U.S. Cl.

CPC ..... *A45F 5/00* (2013.01); *A45F 5/102* (2013.01); *A45F 2005/002* (2013.01); *A45F 2005/008* (2013.01); *A45F 2005/125* (2013.01)

(58) Field of Classification Search

CPC .... B42F 9/001; B42F 9/002; A45F 2005/125; A45F 2005/008; A45F 2005/1053; A45F 5/1026; B43L 3/008; B42D 5/006

USPC ..... 108/43; 248/444, 230.8; 224/222, 267, 224/270

See application file for complete search history.

(56) References Cited

U.S. PATENT DOCUMENTS

| | | | | | |
|---|---|---|---|---|---|
| 728,613 | A | * | 5/1903 | Price | B41J 29/15 400/718 |
| 1,344,498 | A | * | 6/1920 | Fox | B60N 3/001 281/44 |
| 2,150,709 | A | * | 3/1939 | Bake | B60N 3/005 281/45 |
| 2,244,861 | A | * | 6/1941 | Walker | B60N 3/005 108/44 |
| 2,516,239 | A | * | 7/1950 | Moss | B42F 9/001 248/444 |
| D164,269 | S | | 8/1951 | Whittier | |
| 2,590,732 | A | | 3/1952 | Simancik | |
| 2,881,009 | A | * | 4/1959 | Delaney | G04F 7/10 108/43 |
| 2,914,222 | A | | 11/1959 | Meshberg | |
| 3,083,427 | A | * | 4/1963 | Grenon | G03D 15/08 248/489 |
| 3,215,453 | A | | 11/1965 | Malcom, Jr. | |

(Continued)

*Primary Examiner* — Justin M Larson

(74) *Attorney, Agent, or Firm* — The Webb Law Firm

(57) ABSTRACT

A device is disclosed for carrying sets of documents of various sizes utilizing at least a document support tray supported on the forearm of a carrier by a forearm supporter secured by a single arm and hand of a carrier such that the documents may easily be delivered utilizing the free arm of the carrier to selectively pick from one of the stacks made available through the device. The device also includes a holder to secure an animal repellent container. The device includes a at least one tine extending from the document support tray for supporting boxes or bags. The device provides a novel method of delivering mail whereby the carrier may have free use of the hand and arm opposite to that engaged by the device.

15 Claims, 12 Drawing Sheets

(56) References Cited

U.S. PATENT DOCUMENTS 3,232,685 A 2/1966 Wilstein et al.
3,443,333 A 5/1969 Manatos
3,445,046 A 5/1969 Wilson
3,730,077 A * 5/1973 Selden ..... A47B 19/10 108/43
3,754,646 A 8/1973 Henig
3,766,865 A 10/1973 Cutler
3,791,314 A * 2/1974 Berretta ..... A47B 23/002 108/43
3,848,547 A 11/1974 Schaefer
3,875,396 A 4/1975 Webb
4,016,666 A 4/1977 Finn et al.
D249,592 S 9/1978 Libonati
4,153,927 A 5/1979 Owens
4,243,249 A 1/1981 Goss
4,254,872 A 3/1981 Garrett
4,316,338 A 2/1982 Mason et al.
4,442,780 A 4/1984 Child
4,610,054 A * 9/1986 Malian ..... B42D 5/006 24/67 R
4,726,607 A * 2/1988 White ..... B42D 17/00 211/86.01
4,767,093 A * 8/1988 Jones ..... B41J 29/15 248/205.2
D298,955 S * 12/1988 Zovar ..... D19/88
4,919,037 A 4/1990 Mitchell
D308,542 S 6/1990 De Witt
D316,727 S 5/1991 Greenspahn
5,016,147 A 5/1991 Voorhees
5,088,121 A 2/1992 Wallace
5,088,624 A 2/1992 Hackett et al.
5,127,545 A 7/1992 French
D329,061 S * 9/1992 Szablak ..... D19/86
5,261,581 A * 11/1993 Harden, Sr. ..... F41B 5/1469 124/23.1
5,323,910 A 6/1994 van de Graaf, Jr.
5,388,530 A * 2/1995 Jacobus ..... A47B 23/002 108/43
D357,035 S * 4/1995 Toles ..... D19/88
5,566,609 A * 10/1996 Kirschner ..... B62B 3/1428 108/42
5,570,817 A 11/1996 Anderson et al.
5,607,090 A 3/1997 Brown
5,615,817 A 4/1997 Shevers, Jr.
D379,868 S 6/1997 Robinson
5,690,309 A * 11/1997 Blum ..... A47B 23/041 248/444
5,810,220 A 9/1998 Petersen
5,836,488 A 11/1998 Priestley
5,845,826 A 12/1998 Nguyen
5,887,839 A * 3/1999 Smith ..... B42F 9/002 2/160
5,955,170 A 9/1999 Davis et al.
5,961,003 A 10/1999 Coryell
6,050,201 A * 4/2000 Blanchard ..... A47B 23/002 108/43
D453,073 S 1/2002 Kelly, Sr.
6,364,183 B1 * 4/2002 Barnard ..... A45F 5/00 108/43
6,520,394 B2 2/2003 Ulibarri
6,662,733 B1 12/2003 Scott
6,696,986 B1 * 2/2004 Harrison, Jr. ..... G06F 1/163 224/219
6,726,070 B2 4/2004 Lautner
6,734,842 B2 5/2004 Woodmansee et al.
6,796,467 B2 * 9/2004 Caldana ..... H04B 1/385 224/165
6,840,415 B1 * 1/2005 Sapien, Jr. ..... A45F 5/00 224/221
7,146,899 B2 12/2006 Imblum et al.
D537,120 S * 2/2007 Mandel ..... D19/88
7,644,839 B2 1/2010 McNulty, Jr.
D611,543 S * 3/2010 Chen ..... D19/88
7,712,408 B1 5/2010 Copeland et al.
8,328,056 B2 12/2012 Berdych
9,464,755 B1 * 10/2016 Inman ..... A45F 5/00
9,541,233 B2 * 1/2017 Papania ..... F16M 13/00
D796,186 S * 9/2017 Coleman ..... A44C 5/0007 D3/215
9,870,026 B2 * 1/2018 Papania ..... G06F 1/163
D814,566 S * 4/2018 Ruggles ..... D19/88
10,617,967 B1 * 4/2020 Oxenford ..... A63J 7/005
D899,519 S * 10/2020 Lengyel ..... D19/88
2002/0011020 A1 1/2002 Nelson et al.
2004/0046669 A1 3/2004 Chiapperini
2005/0053769 A1 3/2005 Imblum et al.
2012/0291256 A1 * 11/2012 Yu ..... F16M 11/10 29/428
2013/0240578 A1 * 9/2013 Yu ..... H04B 1/385 224/197

* cited by examiner

DEVICE FOR CARRYING SETS OF DOCUMENTS AND CONTAINERS OF VARIOUS SIZES

CROSS REFERENCE TO RELATED APPLICATIONS

This application claims the benefit of U.S. Provisional Application No. 62/825,907 filed Mar. 29, 2019 and hereby incorporates by reference in its entirety the contents of that application. This application incorporates by reference in its entirety the contents of U.S. Pat. No. 8,328,056.

BACKGROUND OF THE INVENTION

Field of the Invention

This invention is directed to the document handling device with features that permit the device to support boxes and bags.

Description of Related Art

When documents are provided to a mail carrier from the United States Postal Service, they are essentially divided into three groups. Direct point sequence bar coded mail (DPS mail) is machine sorted and provided to carriers in presorted bundles for specific addresses. Mail that is not able to be sorted by the sorting machines is hand sorted to the level of individual mail carrier routes and the individual mail carrier must then further sort this mail for specific addresses. Finally, mail carriers must deliver mass mailing literature that is uniformly distributed to each address. Given not only the large volume of mail a typical mail carrier must deliver, but, furthermore, the variety of types of mail in separate bundles and the need to collate the bundles on the fly prior to delivery, it becomes very challenging for a mail carrier to efficiently perform the mail delivery tasks inherent with each route.

DPS mail sorting machines have dramatically cut in-office labor costs but have transferred additional duties to the carrier. A device and method is needed to enhance the efficiency of mail distribution for a mail carrier along the mail carrier's route.

In the course of delivering mail over a postal route, a mail carrier typically encounters various animals, of which the most common and most threatening are dogs. Although mail carriers are supplied with an animal repellant in the form of a container with a spray repellant, the container is often knocked loose and lost unbeknownst to the carrier. If the container has not been lost previously during the day, retrieving this container, aiming the spray at the dog, and activating the spray all consume valuable time when the carrier is under attack and requires the carrier to focus more on these actions than on the threatening dog. Additionally, handfuls of mail may be dropped and the satchel may need to be removed for defensive purposes. The satchel may be very heavy and difficult to maneuver and picking up dropped mail is very time consuming. As a result, a device is also needed to make it easier and faster for the mail carrier to activate the repellant spray when under attack or merely threatened with an attack.

FIGS. 1-5 represent a prior art device 10 held by a carrier 15. The device 10 is adapted to be supported between the carrier's inner forearm and his or her body.

The device 10 is used for carrying documents of various sizes in such a manner to permit convenient access to the top most documents and rapid coordinated distribution of the desired documents. The device 10 is comprised of a document support tray 20 for accepting and retaining documents 25 (shown in phantom). The tray 20 has a first end 30 and an opposing second end 32, a first edge 34 and an opposing second edge 36, and a top surface 38 and a bottom surface 40. A longitudinal axis 42 extends along the length of the tray 20 between the first end 30 and the second end 32.

A forearm supporter 50 is also attached to the tray 20. The forearm supporter 50 is adapted to at least partially engage the forearm of a carrier 15. The forearm supporter 50 is positioned adjacent to the bottom surface 40 of the tray 20. Additionally, the tray 20 has a ledge 52 positioned at the first end 30 of the tray 20.

The forearm supporter 50 is mounted to the bottom surface 40 of the tray 20 and, briefly referring to FIG. 1, the tray 20 is oriented to receive the forearm of the carrier when the tray's first end 30 rests against the torso of the carrier. Returning to FIGS. 2-5, the forearm supporter 50 may be arcuate with the concave side 54 facing the bottom surface 40 of the tray 20. As a result of this design when held by a carrier, the natural range of motion of a carrier's forearm tends to urge the device 10 against the body of the carrier 15.

The carrier may be provided with animal repellant. A typical animal repellant provided to carriers to deter animal attacks is a canister having a spray nozzle so that liquid repellant may be directed from a distance toward an animal. The device 10 may include a repellant holder 60 attached to the tray 20 for holding a repellant container 65 with the spray nozzle 67 of the repellant container extending therefrom. The repellant holder 60 may be in the form of a tube mounted upon the tray 20 and adapted to receive a cylindrical spray repellant container 65 and to direct the container spray away from the bottom surface 40 of the tray 20. By doing so and once again briefly referring to FIG. 1, with the repellant spray directed downwardly from the tray 20, the carrier may move his or her arm to reorient the tray 20 thereby reorienting the spray nozzle 67 for dispersion in a different direction. The repellant holder 60 may be positioned proximate to the expected location of the fingers of the carrier 15 for easy access to activate the spray repellant. The repellant holder 60 may be mounted to the bottom surface 40 of the tray 20 near the first end 30 of the tray 20. Additionally, the repellant holder 60 may be oriented in the direction generally perpendicular to the longitudinal axis 42 of the tray 20.

It should be appreciated that the relative location of the elements of the device 10 are intended to permit the carrier 15 to blindly pull documents from different locations and to activate the animal repellant without the need to first locate the repellant container visually.

The prior art device provides an apparatus whereby the efficiency and the safety of mail carriers may be significantly improved.

SUMMARY OF THE INVENTION

A device is provided for carrying sets of documents of various sizes in such a manner to permit convenient access to the topmost documents and rapid, coordinated distribution of the desired documents. The device is adapted to be supported between a carrier's forearm and his body. The device has a) a document support tray for accepting and retaining documents, wherein the document support tray has first and second ends, first and second edges, and a top and a bottom surface, wherein a longitudinal axis extends between the first end and the second end; b) a forearm supporter attached to the tray, wherein the forearm supporter is adapted to only partially engage the forearm of the carrier, and wherein the forearm supporter is positioned adjacent to the bottom surface of the tray; and c) at least one tine extending along the bottom of the document support tray in a direction from the first end towards the second end of the document support tray. The tine extends beyond and is unsupported beyond the second end of the document support tray to define a cantilevered portion.

BRIEF DESCRIPTION OF THE DRAWINGS

These and other features of the present invention will become more apparent from the following description in which reference is made to the appended drawings wherein.

DESCRIPTION OF THE INVENTION

Figure 1:
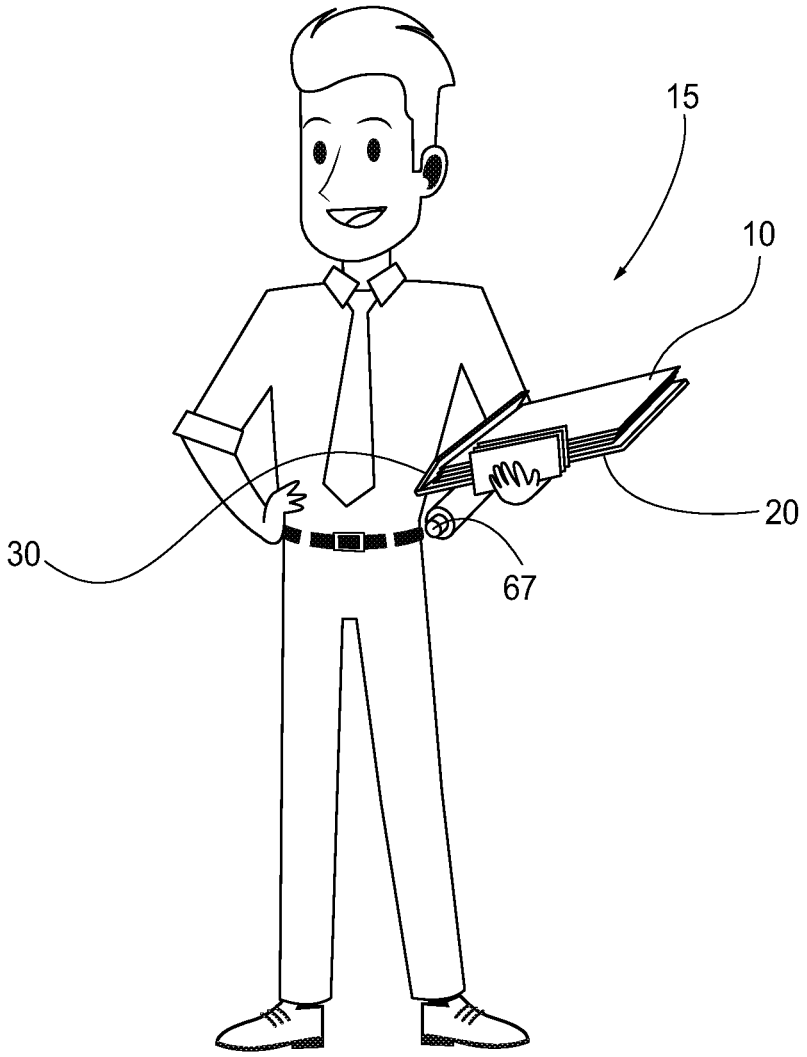
PRIOR ART FIG. 1
FIG. 1 is prior art and illustrates a mail carrier holding one embodiment of the device in accordance with the subject application.
Figure 4:
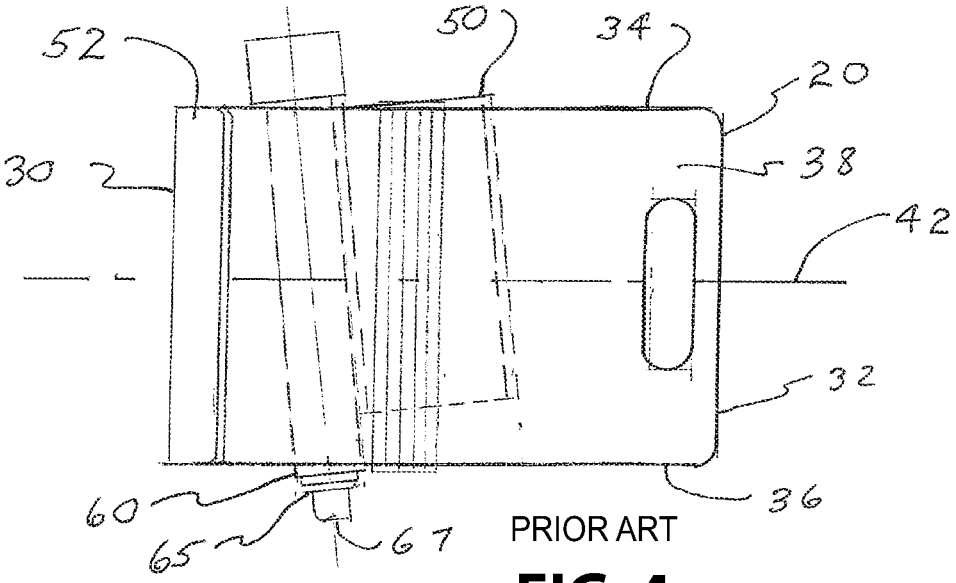
PRIOR ART FIG. 4
FIG. 4 is prior art and illustrates a top view of the device illustrated in FIG. 1.
Figure 5:
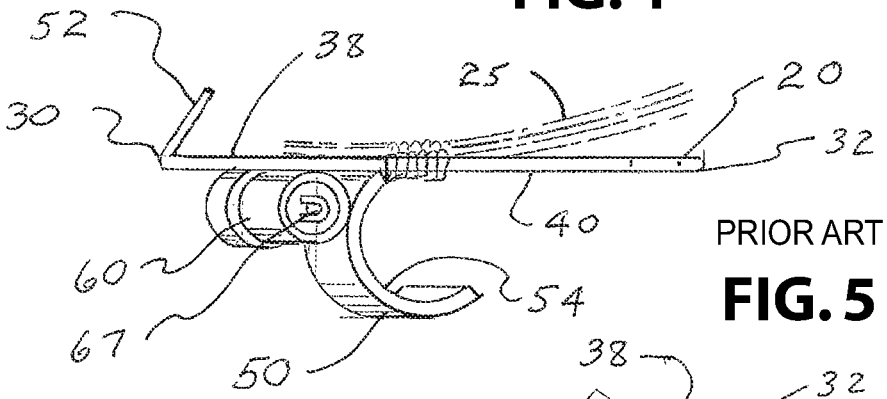
PRIOR ART FIG. 5
FIG. 5 is prior art and illustrates a side view of the device illustrated in FIG. 1.
Figure 2:
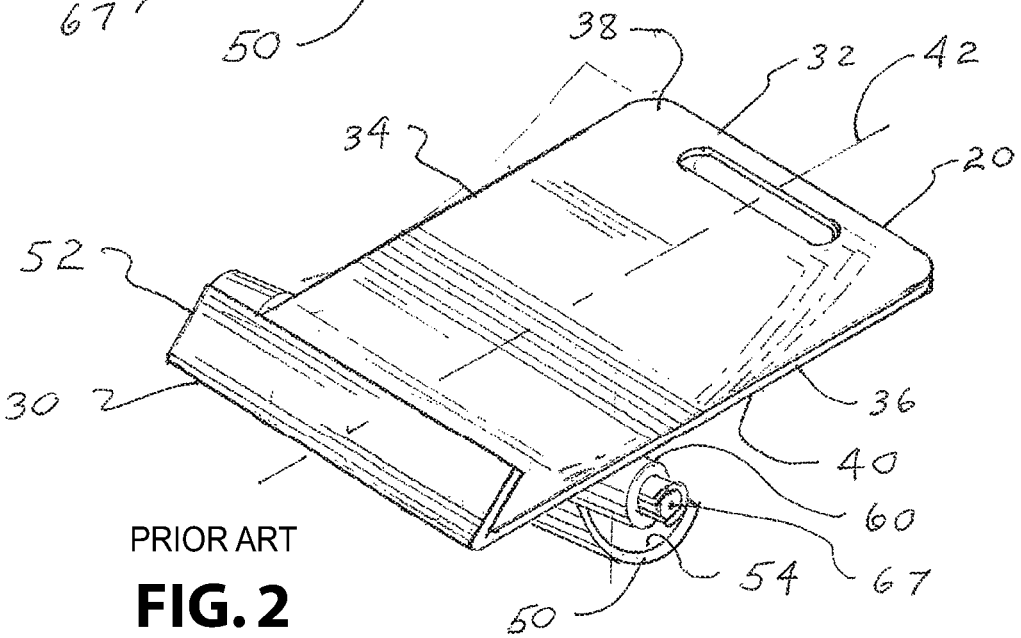
PRIOR ART FIG. 2
FIGS. 2 and 3 are prior art and illustrate perspective views of the device illustrated in FIG. 1.
Figure 3:
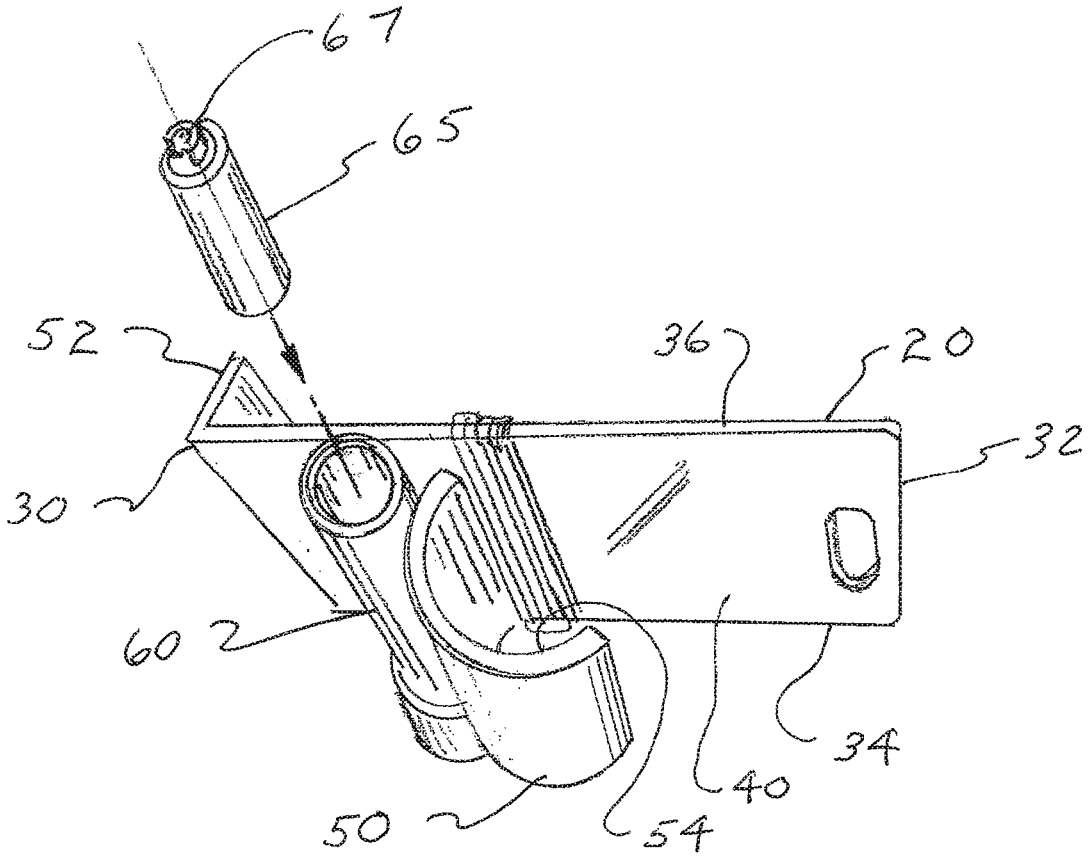
PRIOR ART FIG. 3

For convenience, for like parts of the subject invention and the prior art described in FIGS. 1-5, common reference numerals will be used. However, for those features associated with the present invention, numbers in the 200 and 300 series will be utilized with the understanding that there may be some part overlap.

Figure 6:
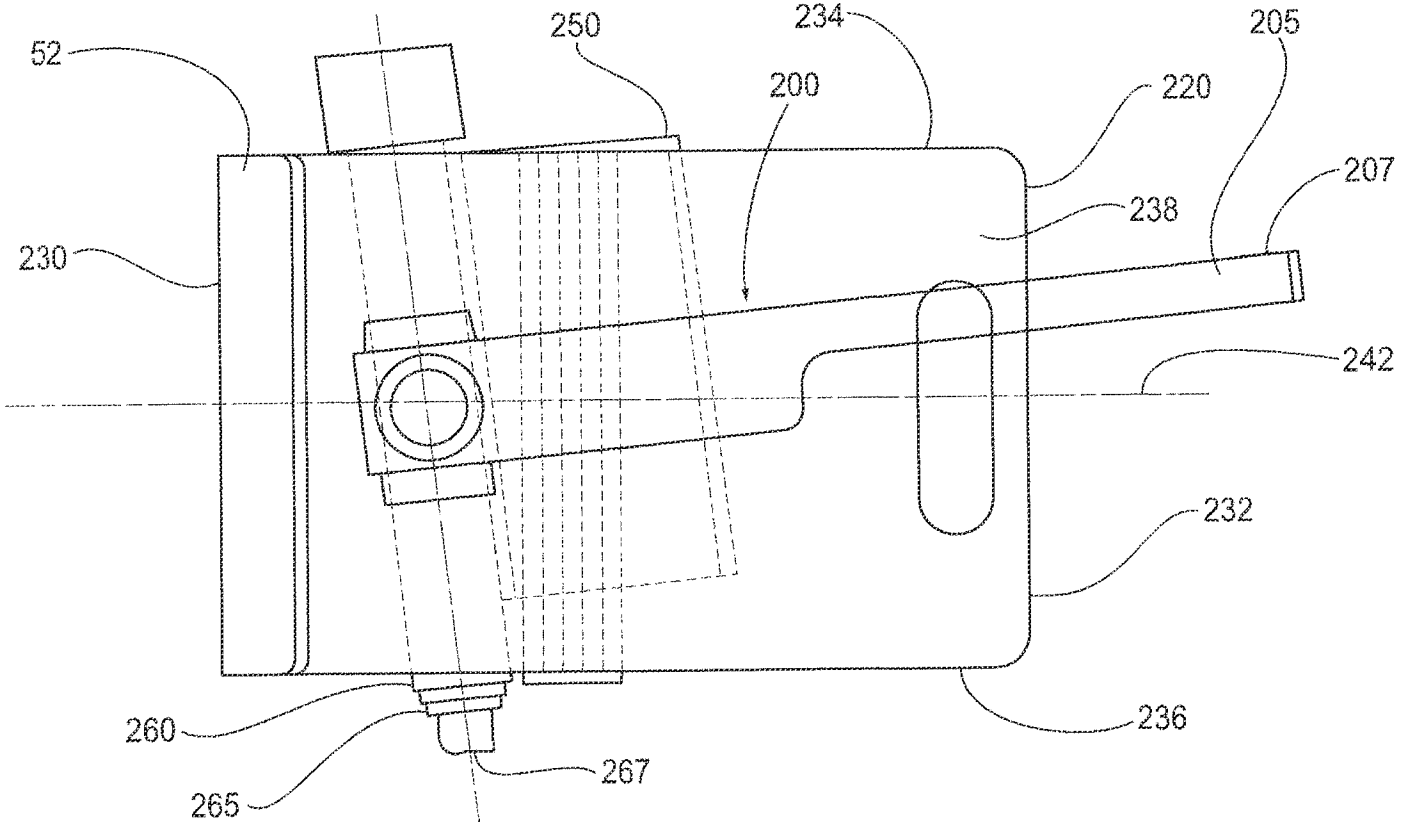
FIG. 6 is prior art and illustrates a top view similar to FIG. 4 but further illustrates the tine assembly of the subject invention.
Figure 7A:
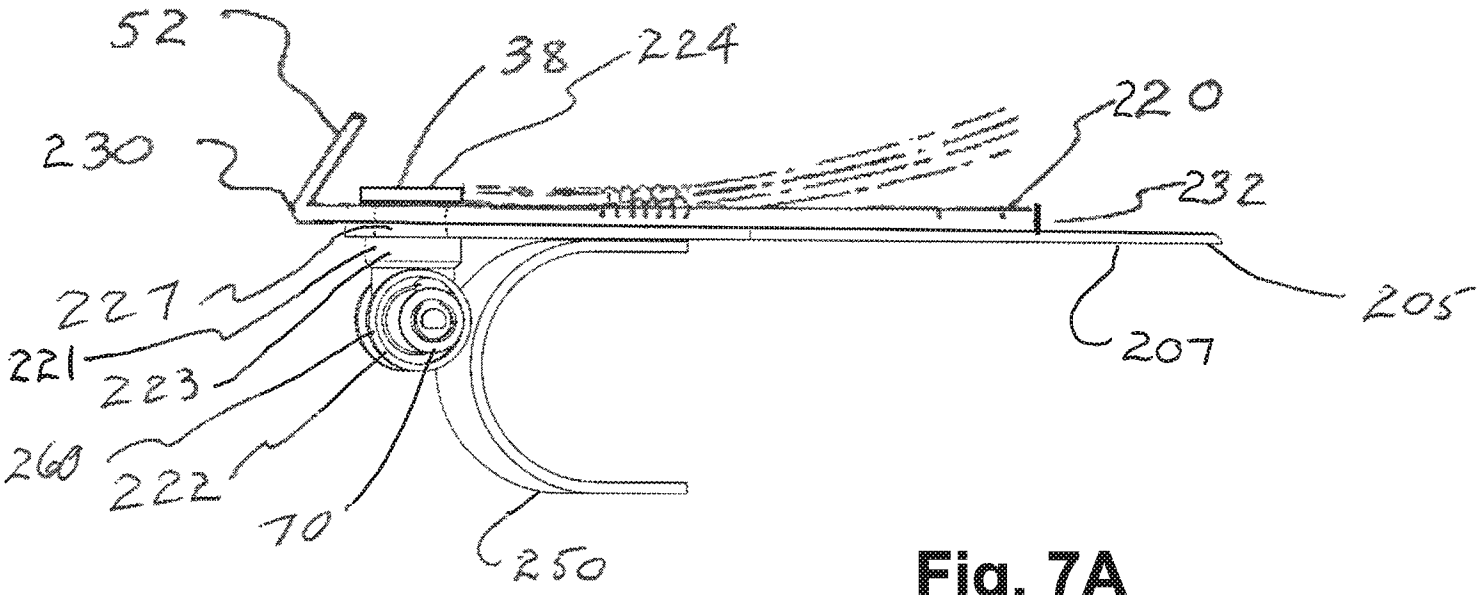
FIG. 7A is side view similar to FIG. 5 but further illustrates the tine assembly in accordance with the present invention.

FIGS. 6 and 7A illustrate a tine 205 secured either directly or indirectly to the bottom surface 240 of the document support tray 220. The forearm supporter 250 and the tine 205 are secured to the document support tray 220.

The forearm supporter 250 may be secured directly to the bottom surface 207 of the tine 205 through adhesive or mechanical fasteners or any other manner known to those skilled in the art. The forearm supporter 250 and the tine 205 may also be secured indirectly to the bottom surface 240 of the document support tray 220 through the T-connection post 221.

Figure 7B:
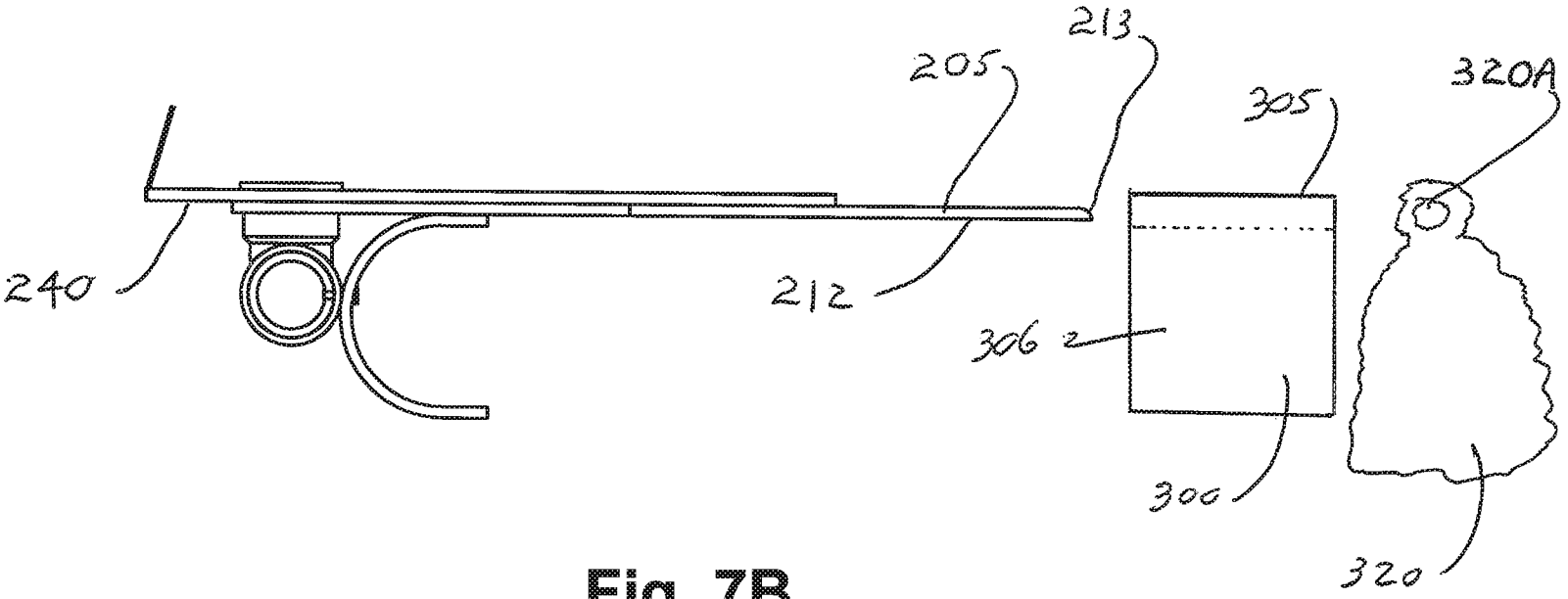
FIG. 7B is a side view showing the manner by which the forearm supporter and tine are secured to the T-connection.

As illustrated in FIGS. 7A and 7B, the tine 205 is positioned between the forearm supporter 250 and the bottom surface 240 of the document support tray 220. The tine 205 illustrated in FIGS. 6 and 7A is also illustrated in perspective in FIG. 8, wherein the tine 205 has a first end 210 and a second end 212. The tine 205 extends along the bottom surface 240 of the document support tray 220 in a direction from the first end 230 towards the second end 232 of the document support tray 220 and along a substantial portion of the document support tray 220. The time 205 also extends beyond the second end. The tine 205 also extends beyond the second end 232 of the document support tray 220 to define a cantilevered portion.

Figure 7C:
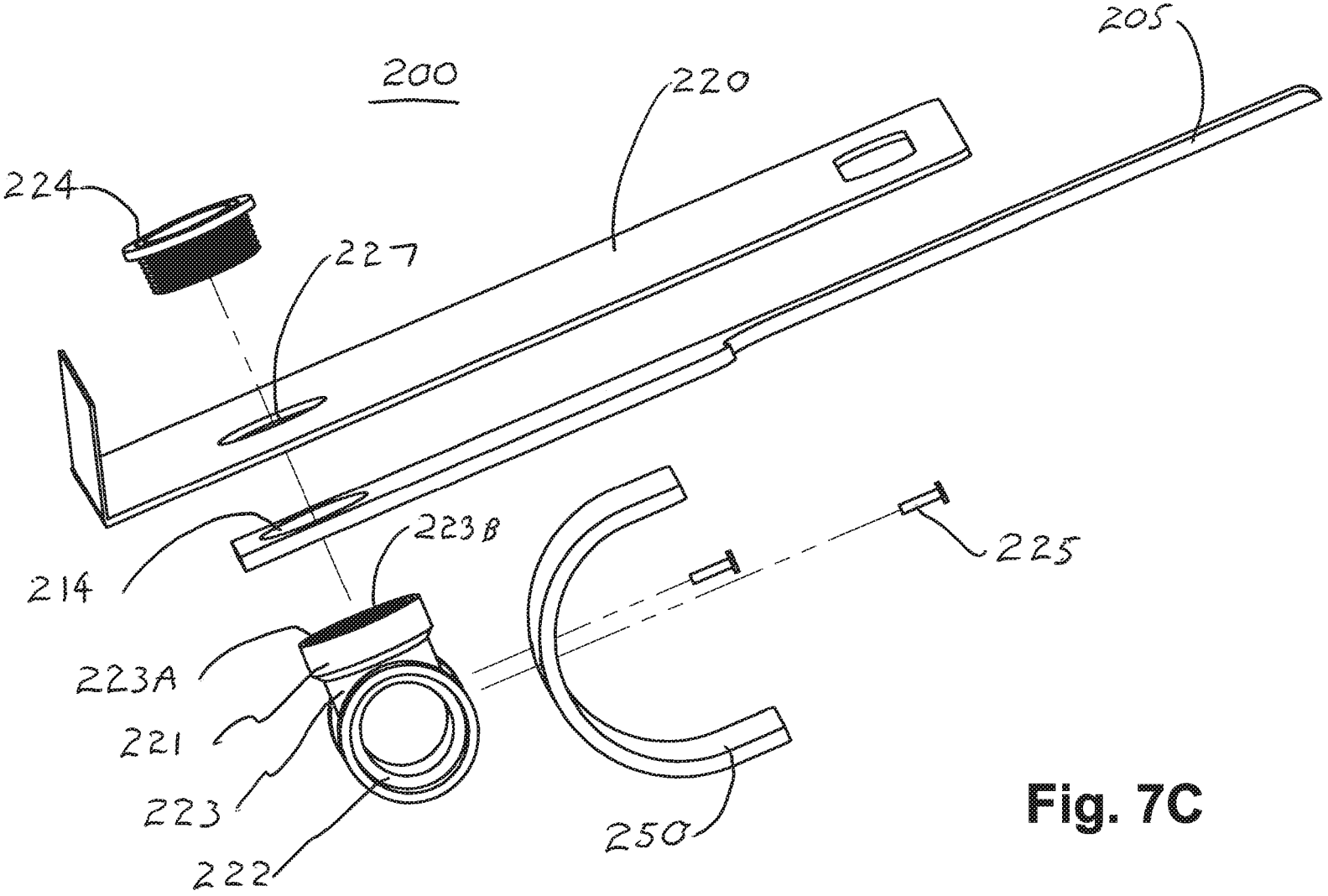
FIG. 7C is a perspective side view showing an exploded view of the tine assembly of FIG. 7B.
Figure 7D:
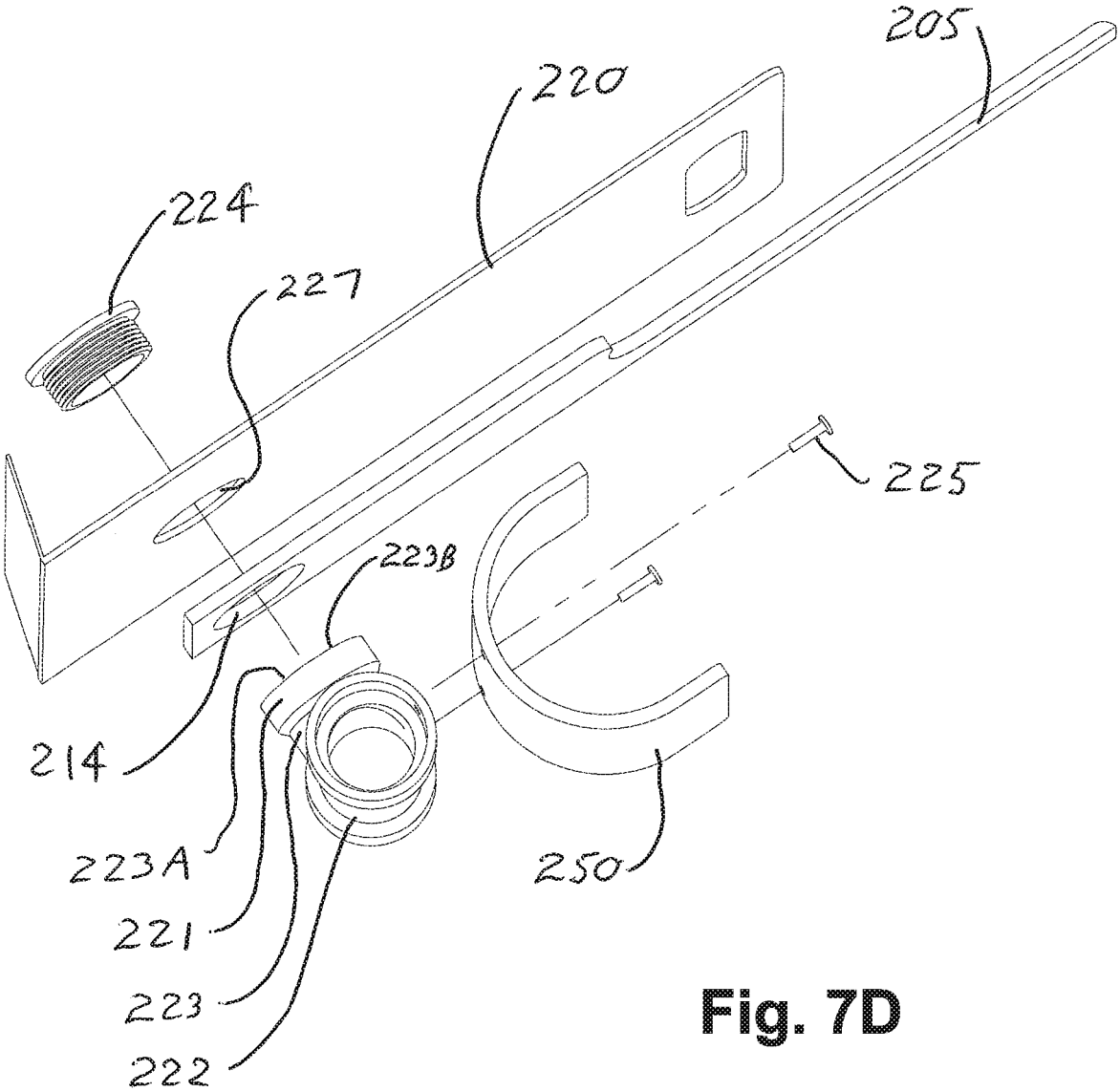
FIG. 7D is a different perspective view showing an exploded view of the tine assembly.

FIGS. 7C and 7D are exploded views of the tine assembly 200 illustrating a tine 205 with the through hole 214. The repellant holder 260 (FIG. 7A) may be fitted within a first branch 222 of the T-connection post 221 with a second branch 223 with a bore 223A having internal threads 223B to accept a threaded plug 224 which extends into the through hole 214 to secure the tine 205 using the T-connection post 221. However, the threaded plug 224 also extends through a hole 227(FIGS. 7C and 7D) extending through the document support tray 220 to secure the tine 205 to the document support tray 220. As illustrated in FIGS. 7A-7D, the forearm supporter 250 may be secured to the first branch 222 of the T-connection post 221 using fasteners 225 such as pop rivets. In the alternative, the forearm supporter 250 may be secured to the bottom surface 207 of the tine 205.

The tine 205 in the assembled condition in FIG. 7B, for example, is adapted to receive a box 300 mounted upon the tine 205. The second end 212 of the tine 205 may have a tapered end 213. The tine 205 may be generally flat. The box 300 includes flaps 305 which may be slightly deformed such that the tapered end 213 of the tine 205 may be inserted within the gap created by the deformation. Essentially, the tine 205 is wedged between the flaps 305 and the core 306 of the box 300.

The tine 205 may also be used to receive and support a bag 320 by inserting the tine 205 through a hole 320A within the bag 320 or attaching the tine 205 to a clip (not shown) from the bag 320.

In general, there may be an opening within the bag 320 through which the tine 205 may be inserted or, since the tine 205 is cantilevered against the bottom surface 240 of the document support tray 220, it is possible that the tine 205 may be resiliently deformed such that a portion of the bag 320 may be compressed and held between the tine 205 and the bottom surface 240 of the document support tray 220.

Briefly returning to FIGS. 6 and 7A, it should further be noted that, the repellant holder 260, which is the first branch 222 of the T-connection post 221, is mounted to the bottom side 207 of the tine 205 using the second branch 223 of the T-connection post 221.

Figure 8:
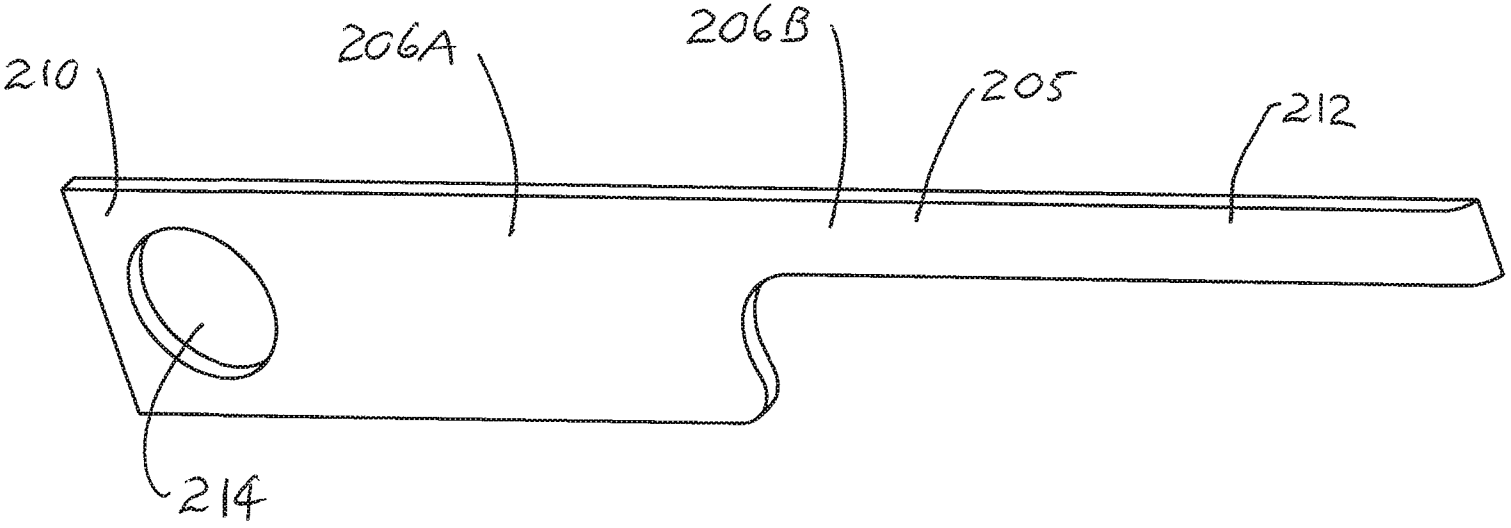
FIG. 8 is a perspective view of one tine.

Directing attention to FIG. 8, for increased structural integrity, the tine 205 may have a wider section 206A proximate to the first end 210 and a narrower section 206B proximate to the second end 212. The tine 205 may also be made of a resilient material to allow deflection. With the intent to secure the tine 205 at the through hole 214 to the document support tray 220, the tine 205 is essentially cantilevered from the through hole 214 and, therefore, the shape of the tine 205 is intended to absorb bending stresses that may be imparted by the weight of any package or box supported by the tine 205. It should be appreciated that in one embodiment, the only connection of the tine 205 to the document support tray is at the hole 214. In this fashion, nearly the entire length of the tine 205 may be used to engage the flaps 305 of a box 300 or an hole 320A in a bag 320.

Figure 9:
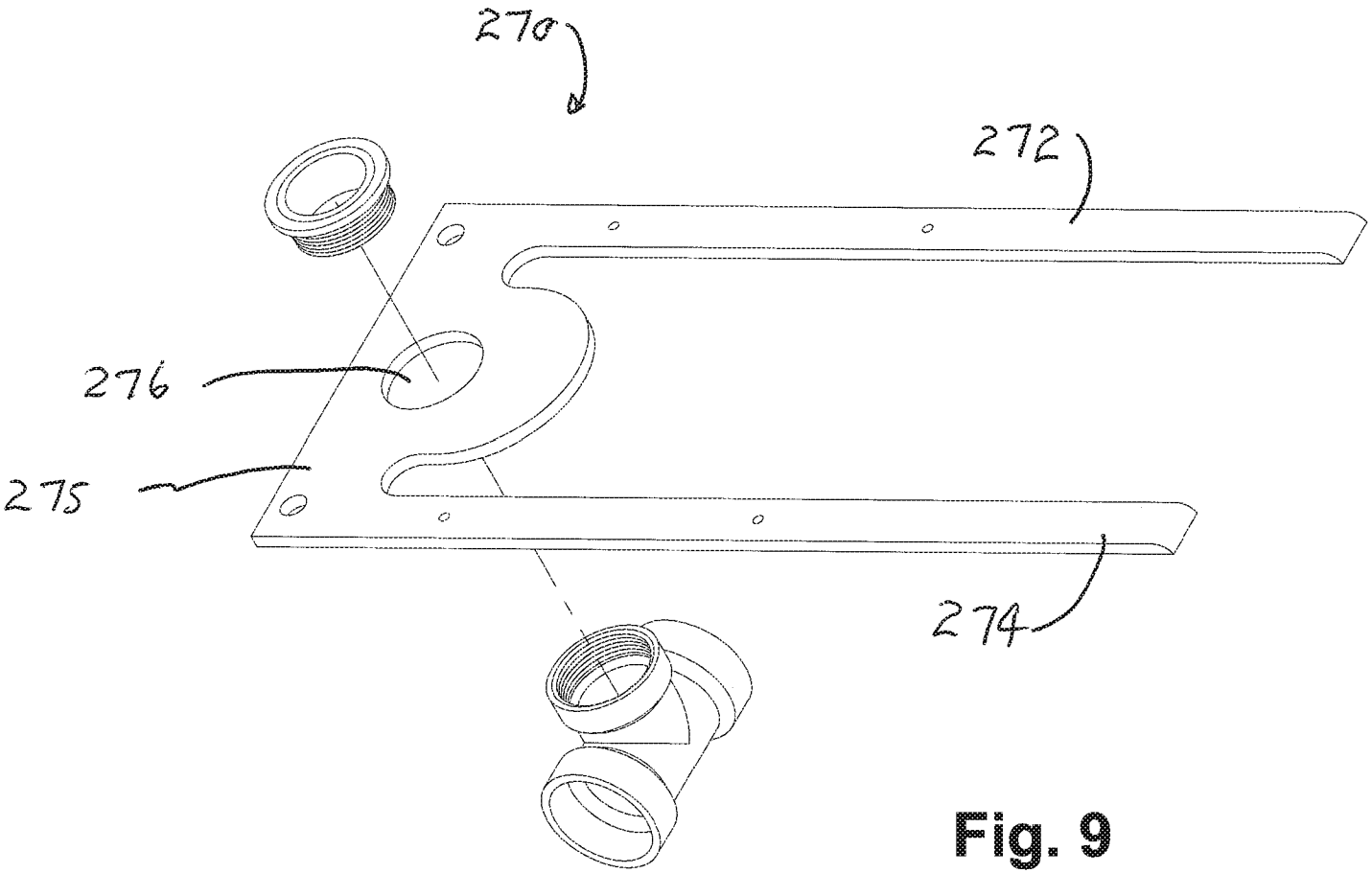
FIG. 9 is an embodiment showing two tines.

What has been discussed so far with respect to FIG. 8 is a single tine. Directing attention to FIG. 9, it is entirely possible for a structure 270 to include two or more tines as illustrated by a first tine 272 and a second tine 274 on a common base 275. It should be appreciated that while FIG. 9 illustrates only two tines, it is possible to include additional tines to support additional boxes or packages. The through hole 276 is similar to the through hole 214 in FIG. 8 and may be secured using the same T-connection post 221 as previously described.

Figure 10:
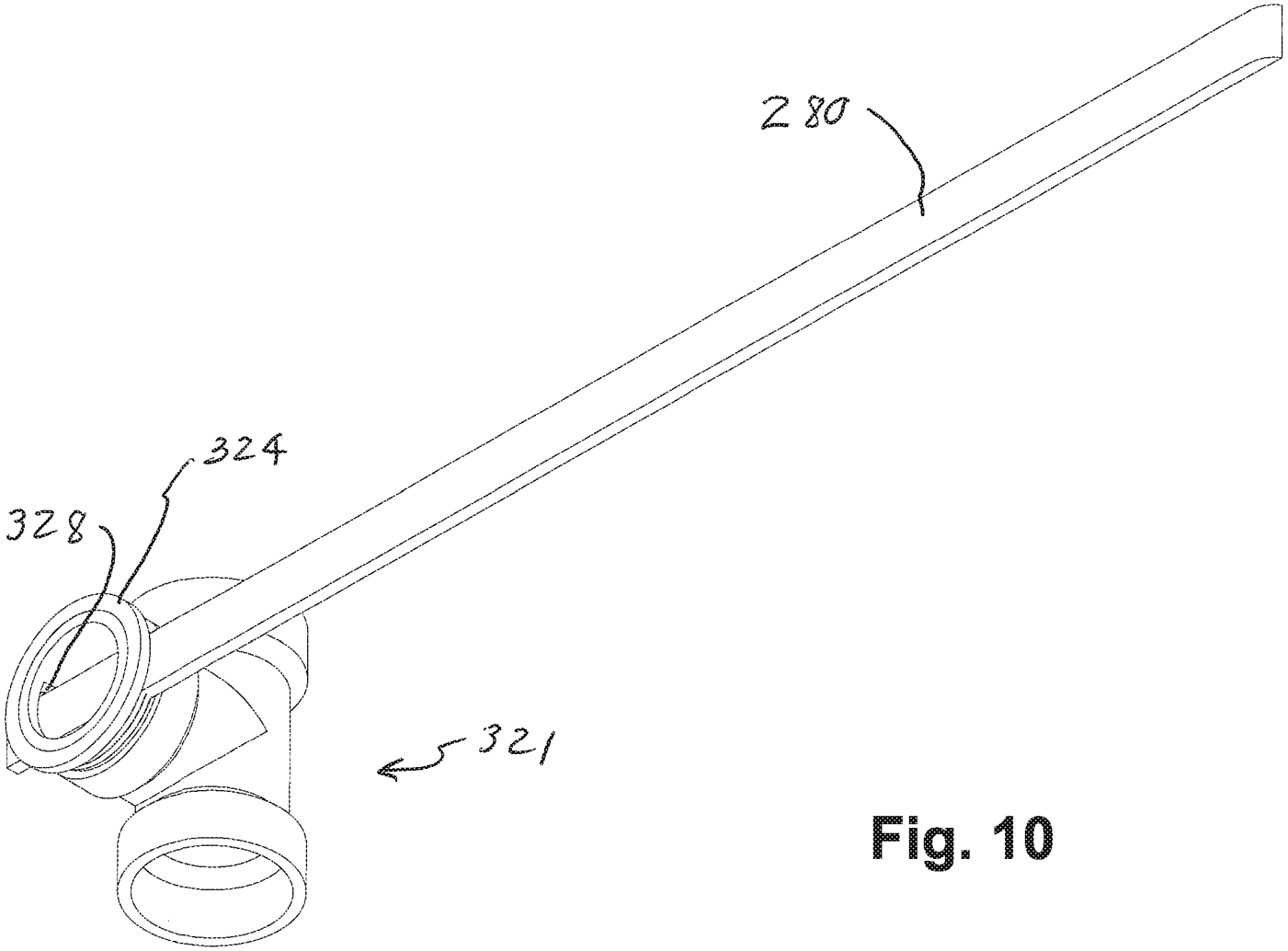
FIG. 10 is an alternate embodiment of part of the tine assembly.
Figure 11:
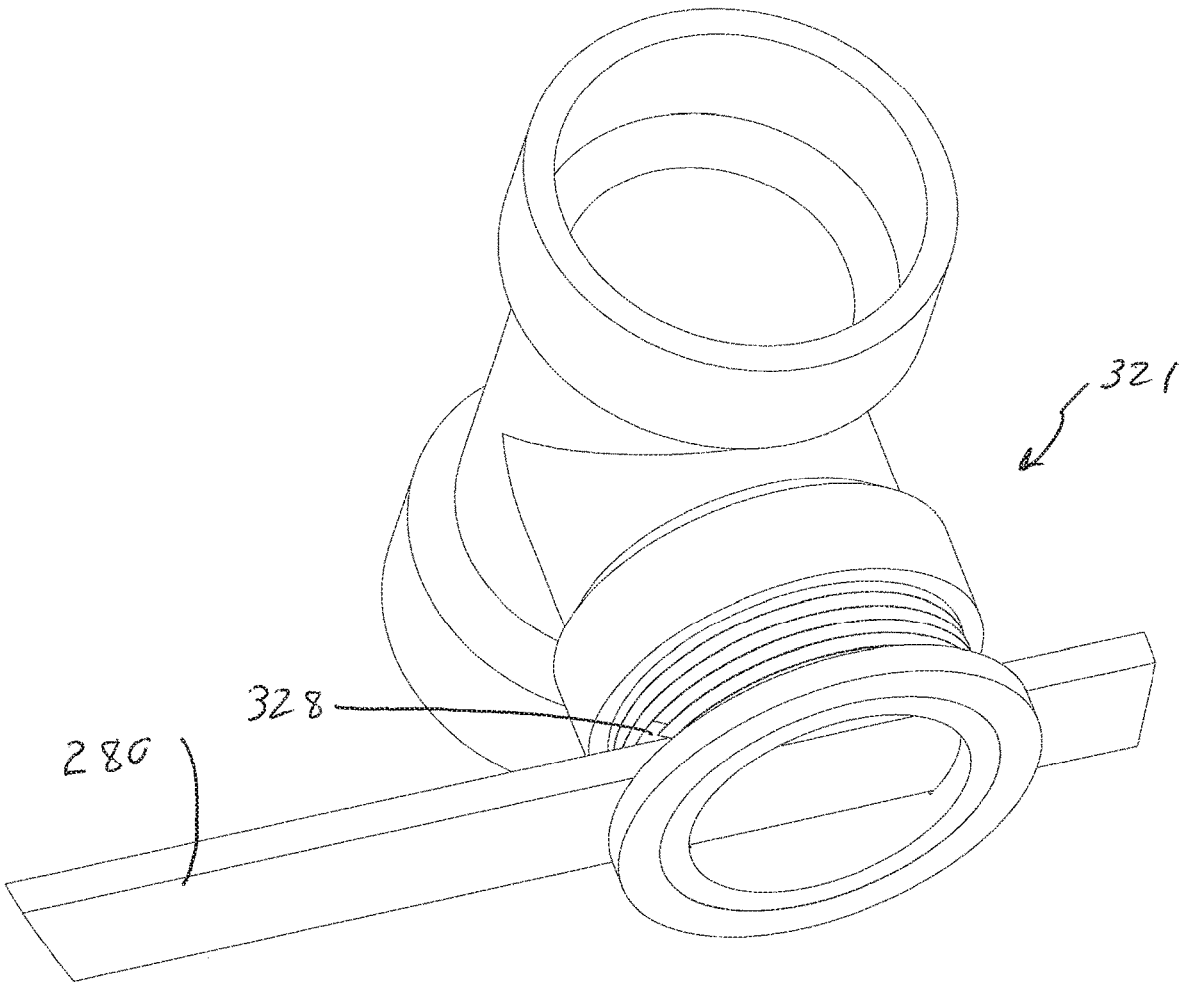
FIG. 11 is an enlargement of a portion of FIG. 10.

As illustrated in FIGS. 10 and 11, it is possible for a tine 280 to be secured within a T-connection post 321 similar to T-connection post 221 but with a slot 328 extending through the threaded plug 324 as previously discussed. The size of the slot 328 is adjustable by advancing the threaded plug 324 within the T-connection post 321. By reducing the size of the slot 328, the tine 280 may be compressed within the slot 328 of the T-connection post 321 by the threaded plug 324 and thereby secured within the slot 328.

While what has been discussed so far is engagement of a box or a bag through engagement of the tine within the flaps of a box or a hole of the bag, it is also possible to secure a box or a bag to the tine using twine or elastic members wrapped around the box and the tine or the bag and the tine or any combination of engagement by the tine discussed herein.

While certain embodiments of the invention are shown in the accompanying figures and described herein above in detail, other embodiments will be apparent to and readily made by those skilled in the art without departing from the scope and spirit of the invention. For example, it is to be understood that this disclosure contemplates that to the extent possible, one or more features of any embodiment can be combined with one or more features of the other embodiment. Accordingly, the foregoing description is intended to be illustrative rather than restrictive.

The invention claimed is:

1. A device for carrying sets of documents of various sizes in such a manner to permit convenient access to the topmost documents and rapid, coordinated distribution of the desired documents, the device adapted to be supported between a carrier's forearm and his body, the device comprising:

a) a document support tray for accepting and retaining documents, wherein the document support tray has first and second ends, first and second edges, and a top and a bottom surface, wherein a longitudinal axis extends between the first end and the second end;

b) a forearm supporter attached to the tray, wherein the forearm supporter is adapted to only partially engage the forearm of the carrier, and wherein the forearm supporter is positioned adjacent to the bottom surface of the tray;

c) at least one tine extending along the bottom of the document support tray in a direction from the first end toward the second end of the document support tray, wherein the tine extends beyond and is unsupported beyond the second end of the document support tray to define a cantilevered portion; and d) wherein the at least one tine has a first end proximate to the first end of the document support tray and a second end opposite thereto and wherein the at least one tine is secured proximate to the first end of the at least one tine.

2. The device according to claim 1, wherein the at least one tine is generally flat.

3. The device according to claim 1, wherein the second end of the at least one tine is tapered.

4. The device according to claim 1, wherein the at least one tine is made of a resilient material.

5. The device according to claim 1, wherein one end of the at least one tine is wider than the other end.

6. The device according to claim 1, wherein the at least one tine comprises two tines spaced from one another on a common base.

7. The device according to claim 1, wherein the at least one tine extends along a substantial portion of the document support tray.

8. The device according to claim 1, wherein the forearm supporter and the at least one tine are secured to the bottom of the document support tray.

9. The device according to claim 8, wherein the forearm supporter and the at least one tine are secured to the bottom of the document support tray through a post.

10. The device according to claim 9, wherein the at least one tine is positioned between the document support tray and the forearm support.

11. The device according to claim 10, wherein a hole extends through the document support tray and the post extends through the document support tray and engages the at least one tine.

12. The device according to claim 11, wherein a hole extends through the tine and the post extends through both the hole in the tray and the hole in the tine to secure the at least one tine to the document support tray.

13. The device according to claim 11, wherein the post has a slot therethrough and the at least one tine is secured within the slot to engage the at least one tine to the document support tray.

14. The device according to claim 13, wherein the slot size is adjustable and may be compressed upon the at least one tine to secure the at least one tine.

15. A device for carrying sets of documents of various sizes in such a manner to permit convenient access to the topmost documents and rapid, coordinated distribution of the desired documents, the device adapted to be supported between a carrier's forearm and his body, the device comprising:

a) a document support tray for accepting and retaining documents, wherein the document support tray has first and second ends, first and second edges, and a top and a bottom surface, wherein a longitudinal axis extends between the first end and the second end;

b) a forearm supporter attached to the tray, wherein the forearm supporter is adapted to only partially engage the forearm of the carrier, and wherein the forearm supporter is positioned adjacent to the bottom surface of the tray;

c) at least one tine extending along the bottom of the document support tray in a direction from the first end toward the second end of the document support tray, wherein the tine extends beyond and is unsupported beyond the second end of the document support tray to define a cantilevered portion;

d) wherein the forearm supporter and the at least one tine are secured to the bottom of the document support tray;

e) wherein the forearm supporter and the at least one tine are secured to the bottom of the document support tray through a post; and f) wherein the at least one tine is positioned between the document support tray and the forearm support.

* * * * *